US005533550A

United States Patent [19]

Franke et al.

[11] Patent Number: 5,533,550

[45] Date of Patent: Jul. 9, 1996

[54] TANK VENTING APPARATUS FOR A PACKAGING MACHINE

[75] Inventors: Rickard Franke, Dalby, Sweden; Per Brandstrom, Lake Zurich, Ill.; Yutaka Kaneko, Wheeling, Ill.; Bengt Andersson, Buffalo Grove, Ill.

[73] Assignee: Tetra Laval Holdings & Finance S.A., Pully, Switzerland

[21] Appl. No.: 315,958

[22] Filed: Sep. 30, 1994

[51] Int. Cl.[6] ..... B65B 3/00

[52] U.S. Cl. ..... 141/51; 141/90; 141/93; 141/60; 141/290

[58] Field of Search ..... 141/1, 44, 51–53, 141/59, 60, 89–93, 97, 253, 275–278, 290, 302, 308, 309

[56] References Cited

U.S. PATENT DOCUMENTS

| | | | |
|---|---|---|---|
| 530,827 | 12/1894 | Dales . | |
| 654,714 | 7/1900 | Colby . | |
| 1,442,405 | 1/1923 | Hawthorne . | |
| 1,655,312 | 1/1928 | Daniel . | |
| 2,028,283 | 1/1936 | Howard et al. . | |
| 2,056,828 | 10/1936 | Clawson . | |
| 2,302,693 | 11/1942 | Hoar | 141/51 X |
| 2,428,598 | 10/1947 | Weaver | 141/51 |
| 2,524,560 | 10/1950 | Cote | 141/93 X |
| 2,704,620 | 3/1955 | Perri et al. . | |
| 2,733,848 | 2/1956 | Houwers . | |
| 2,839,093 | 6/1958 | McCarthy | 141/51 |
| 3,381,723 | 5/1968 | Quest | 141/53 X |
| 3,685,554 | 8/1972 | Encke | 141/59 |
| 3,710,380 | 1/1973 | Gilson . | |
| 4,417,607 | 11/1983 | Scholle et al. | 141/1 |
| 4,964,444 | 10/1990 | Hanerus et al. | 141/90 |
| 5,031,673 | 7/1991 | Clusserath | 141/92 X |
| 5,332,011 | 7/1994 | Spalding . | |

FOREIGN PATENT DOCUMENTS

| | | | |
|---|---|---|---|
| 1322086 | 2/1963 | France | 141/290 |
| 3613394 | 10/1987 | Germany | 141/93 |

*Primary Examiner*—J. Casimer Jacyna
*Attorney, Agent, or Firm*—McAndrews, Held & Malloy, Ltd.; Patrick N. Burkhart

[57] ABSTRACT

An apparatus for internally venting a product tank in a packaging machine is set forth. The apparatus includes a filling tube having a first end extending from a first opening of the product tank. The apparatus further includes an air collection mechanism having a filling tube opening adapted to receive a second end of the filling tube. The air collection mechanism extends below the second end of the filling tube. A vent pipe is connected to a second opening of the product tank and to a vent pipe opening in the air collection mechanism. The filling tube and the vent pipe are separately connected to both the product tank and the air collection mechanism. Air pressure, arising from operating the packaging machine, directs air from the air collection mechanism through the vent pipe and into the product tank. Such air proceeds through the vent pipe and replaces product in the product tank as the product is dispersed into the carton during filling.

3 Claims, 5 Drawing Sheets

TANK VENTING APPARATUS FOR A PACKAGING MACHINE

TECHNICAL FIELD

The present invention relates to a tank venting apparatus for a packaging machine. More specifically, the present invention relates to an apparatus for internally venting a product tank in a packaging machine.

BACKGROUND

Packaging machines are known that integrate into a single unit the various components necessary to form a container, fill the container with a liquid product, and seal the container. Such packaging machines typically feed carton blanks into the machine, seal the bottoms of the cartons, fill the cartons with a product dispensed from a product storage tank, seal the tops of the cartons, and off-load the filled cartons for shipping.

As the product is dispensed from the product tank during the packaging process, compensation must be made for the displacement of the product in the product tank. Thus, it is desirable to vent the product tank in order to compensate for the displacement of the product. Where the product is a liquid foodstuff, it may be necessary to maintain a sterile environment in the tank. Therefore, the tank cannot be vented to the open atmosphere.

One solution to the problem of venting the product tank while maintaining a sterile environment in the product tank is set forth in U.S. Pat. No. 5,009,339 to Hanerus et al. The '339 patent illustrates an apparatus for venting a plant for filling containers. The apparatus includes two control valves disposed at an outlet from the product tank and a vacuum pipe and pump assembly provided along an upper edge of the product tank.

Although a product tank can be vented in this manner at conventional operating speeds, new problems are presented as packaging machines are designed for ever-increasing through put capacities. Specifically, cartons are typically lifted into a sterile filling environment. At high operating speeds, sterile air that is displaced by lifting the cartons to be filled into the filling environment presents a problem that is not dealt with in the prior art, namely the problem of venting both the filling environment and the product tank. Additionally, vents disposed exterior to the tank present problems with CIP systems since the vent must necessarily be cleaned in a separate, manual cleaning step.

SUMMARY OF THE INVENTION

An apparatus for internally venting a product tank in a packaging machine is set forth. The apparatus includes a filling tube having a first end extending from a first opening of the product tank. The apparatus further includes an air collection mechanism having a filling tube opening adapted to receive a second end of the filling tube. The air collection mechanism extends below the second end of the filling tube. A vent pipe is connected to a second opening of the product tank and to a vent pipe opening in the air collection mechanism. The filling tube and the vent pipe are separately connected to both the product tank and the air collection mechanism. Air pressure generated by operating the packaging machine directs air from the air collection mechanism through the vent pipe and into the product tank.

In accordance with one embodiment of the apparatus, a container lifter is provided. The container lifter is partially disposed below the filling tube. Air is upwardly displaced as a container is lifted through an open end of the air collection mechanism with the container lifter. The displaced air is directed through the vent pipe and into the product tank.

In accordance with another aspect of the apparatus, a closed, generally sterile housing is provided. The second end of the filling tube, the air collection mechanism, and a second end of the vent pipe are disposed in the generally sterile housing. Since the second end of the vent pipe is disposed in a generally sterile environment, sterile air is directed from the air collection mechanism through the vent pipe and into the product tank.

In a method of venting a fluid dispensing apparatus, a container is moved into a fill position in a first step. The container is adapted to receive fluid dispensed from a product tank. Air, displaced by moving the container into the fill position, is then directed into the product tank through a vent pipe connected to the product tank in a second step. A further step may include dispensing cleaning fluid through both the product tank and the vent pipe simultaneously.

Other objects and advantages of the present invention will become apparent upon reference to the accompanying detailed description when taken in conjunction with the following drawings.

DETAILED DESCRIPTION OF THE PREFERRED EMBODIMENT

Figure 1:
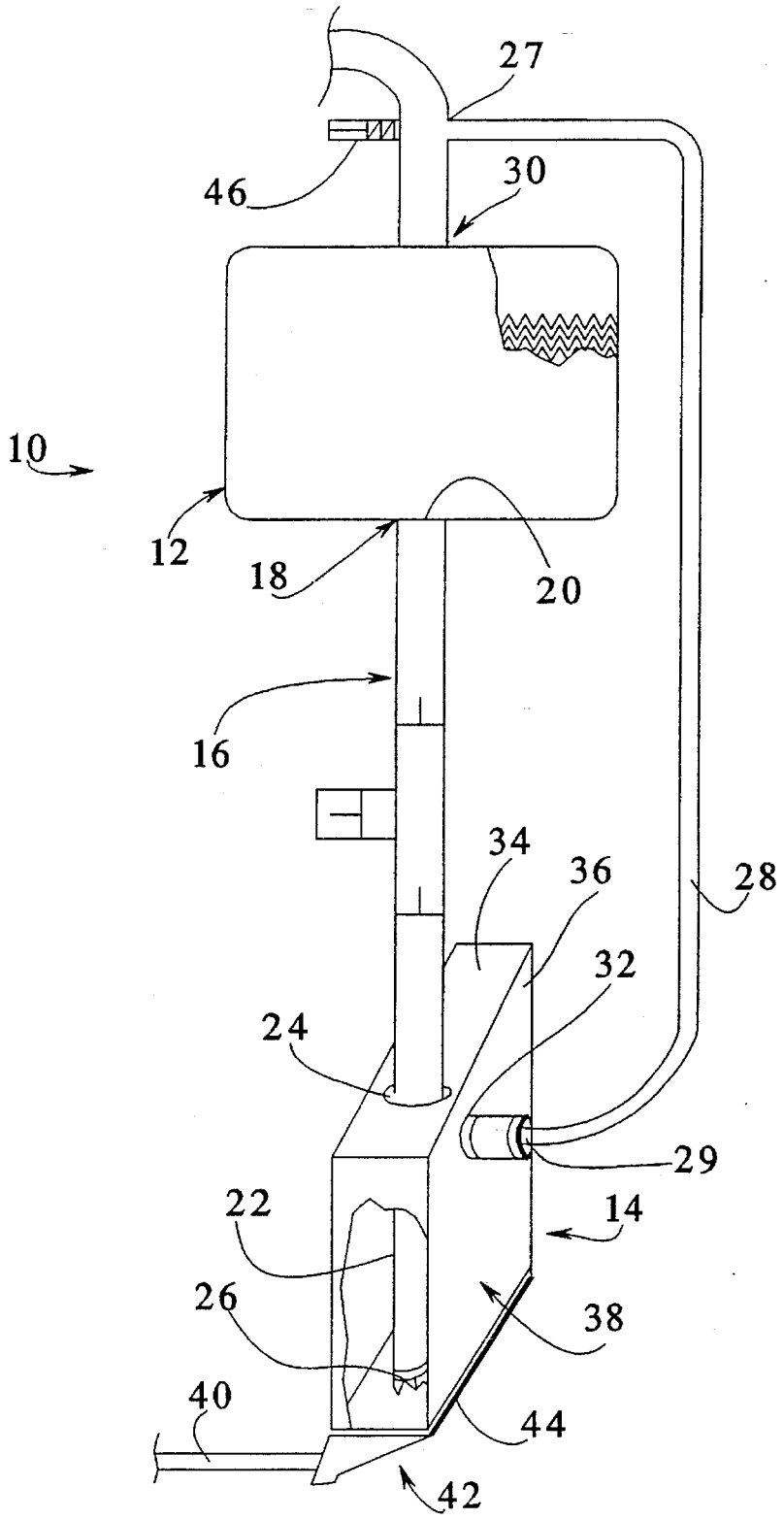
FIG. 1 is a perspective view of one embodiment of a tank venting apparatus.

FIG. 1 illustrates a tank venting apparatus of a packaging machine, shown generally at 10. The tank apparatus 10 includes a product tank 12 and a cleaning box 14 which serves as an air collection mechanism. A filling tube 16 has a first end 18 connected to a first opening 20 in the product tank 12. A second end 22 of the filling tube 16 is seated within the cleaning box 14. A filling tube opening 24, provided in the cleaning box 14, is adapted to receive the second, or dispensing, end 22 of the filling tube 16. A nozzle 26 for dispensing product from the product tank 12 is provided at a terminus of the second end 22 of the filling tube 16.

A vent pipe 28 is connected to both the product tank 12 and to the cleaning box 14 separately from the filling tube 16. A first end 27 of the vent pipe 28 is connected to a second opening 30 in the product tank 12. A second end 29 of the vent pipe 28 is connected to a vent pipe opening 32 in the cleaning box 14. The filling tube opening 24 may be arranged along a top 34 of the cleaning box 14 and the vent pipe opening 32 may be arranged along a top 36 of a first side 38 of the cleaning box 14. As illustrated in FIG. 1, the vent pipe opening 32 is disposed perpendicular to the filling tube opening 24 of the cleaning box 14. During production, air is directed from the cleaning box 14 through the vent pipe 28 and into the product tank 12, thus allowing the product tank 12 to breathe. Specifically, air pressure arising in the cleaning box 14 replaces product in the product tank 12 as the product is dispersed out of the filling tube 16 during the simultaneous filling and lowering of a suitable collection device, or container, 62.

A drain pipe 40 is connected to a drain pipe opening (not shown) provided in a bottom 42 of a second side 44 of the cleaning box 14. A valve 46 is provided between the second opening 30 of the product tank 12 and the vent pipe opening 32 of the cleaning box 14. The valve 46 is open during a production cycle of the packaging machine. Both the drain pipe 40 and the valve 46 are used during a cleaning cycle of the packaging machine.

Figure 2:
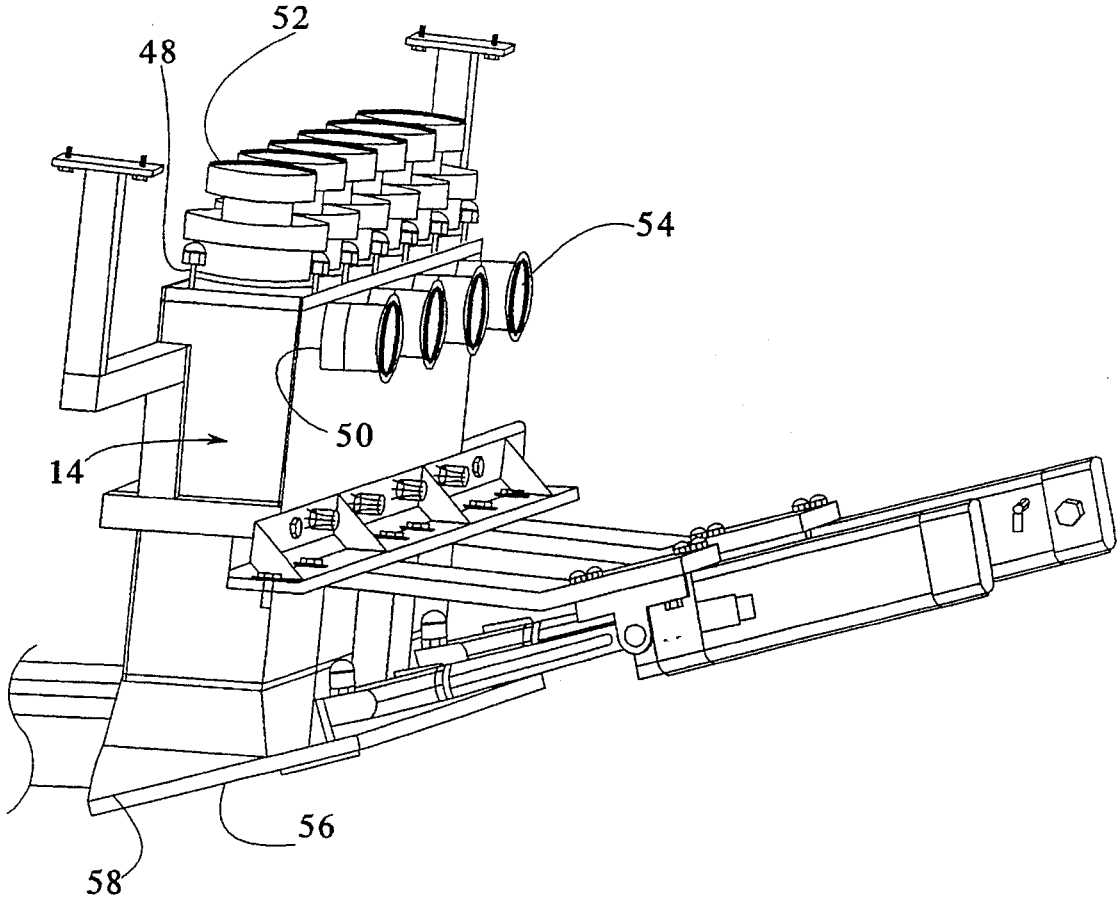
FIG. 2 is a perspective view of an air collection mechanism wherein multiple vent and filling tube openings and a retractable cleaning cover are provided.

A cleaning box 14' can include a number of filling tube openings 48 and a number of vent pipe openings 50, as illustrated in FIG. 2. Each of the filling tube openings 48 is adapted to receive one of the filling tubes 52. Further, each of the vent pipe tubes 50 is adapted to receive one of the vent pipes 54. Additionally, a retractable cover 56 can be removably connected to an open end 58 of the cleaning box 14, as discussed more fully in U.S. Ser. No. 08/316,109 filed on Sep. 30, 1994 and incorporated by reference. During a cleaning cycle of the packaging machine, the cover 56 is disposed over the open end 58 of the cleaning box 14'. The vent pipes 54 are connected to the cleaning box 14' and to the product tank (not shown) such that cleaning fluid cycling through the packaging machine during the cleaning cycle is also cycled through the vent pipes 54 into the cleaning box 14' and through drain pipes 60. In such venting arrangements for packaging machines, the vent cannot be cleaned during the cleaning cycle, since the vent is externally connected to the product tank. Thus, the vents of the previously described, known venting arrangements are difficult, if not impossible to clean. This disadvantage is overcome by a venting apparatus constructed in accordance with the principles discussed herein wherein the vent pipes 54 are cleaned during the cleaning cycle of the packaging machine.

Figure 3:
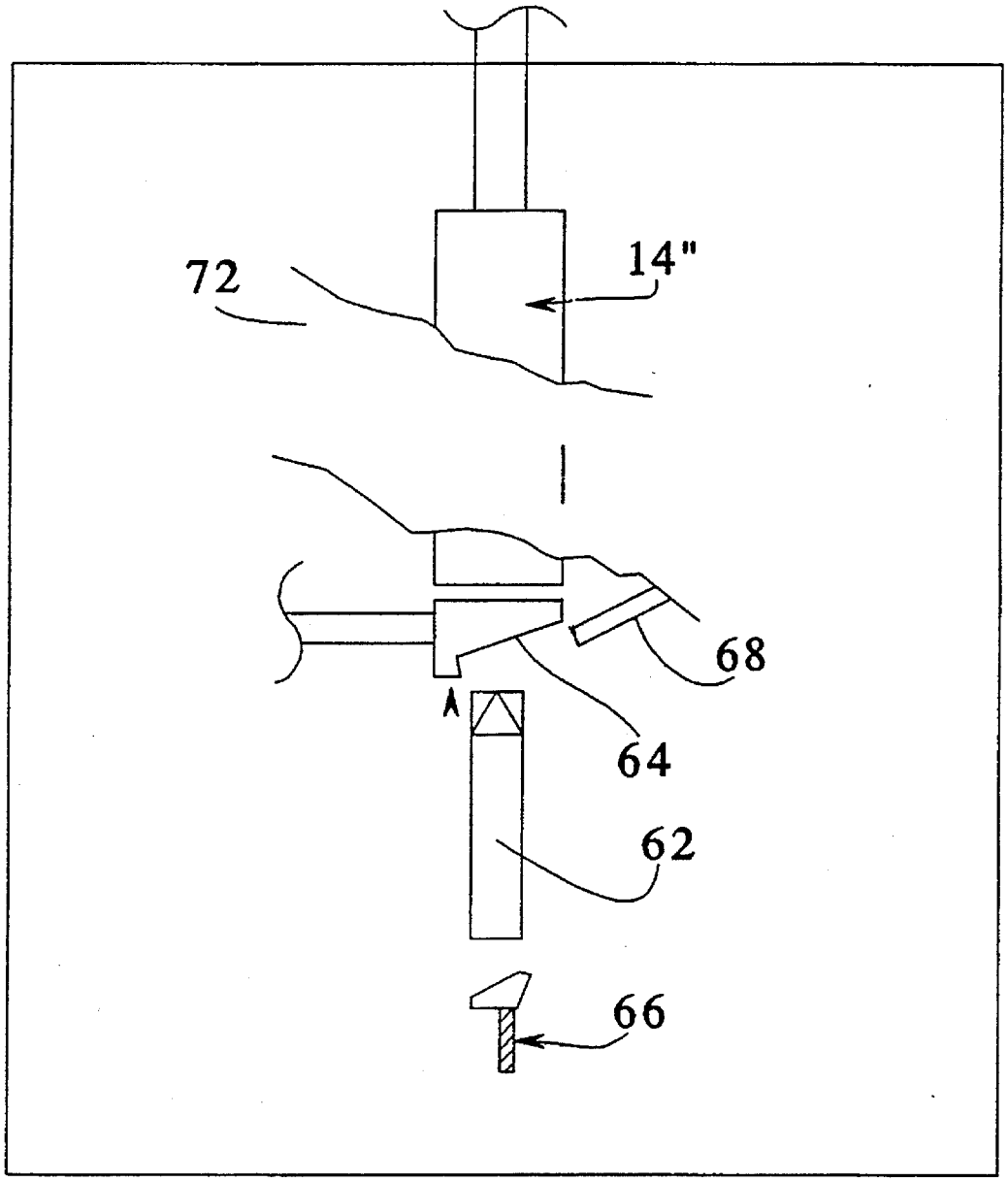
FIG. 3 is a side view, partially in section, of a tank venting apparatus wherein a carton lifter is provided in a generally sterile housing of the packaging machine.

As illustrated in FIG. 3., the suitable collection device, or container 62, such as a gable top carton illustrated in the figure, is lifted into an open end 64 of a cleaning box 14" by a suitable container lifter 66 (shown in section), such as a carton lifter, during production. One exemplary container lifter 66 is discussed more fully in U.S. Ser. No. 08/315,410 and U.S. Ser. No. 08/315,401, both filed on Sep. 28, 1994, and incorporated by reference. The container lifter 66 is partially disposed below a dispensing end of a filling tube housed in the air collection mechanism 14", where the position of the filling tube is illustrated in principle in FIG. 1. A removable cover (discussed with reference to FIG. 2) 68 is maintained in an open position during production. As the container 62 is lifted into the cleaning box 14" through the open end 64 by the container lifter 66, air is upwardly directed into the cleaning box 14", as indicated by the arrow. The upwardly directed air is then vented through a vent pipe into a product tank, such as the vent pipe 28 and product tank 12 shown in FIG. 1.

Certain filling operations of packaging machines require a generally sterile filling environment where air in the filling environment is sufficiently sterile to comply with hygiene standards required in the handling of foodstuffs. Where such requirements exist, a housing 70 can be provided below the product tank. The housing 70 can include a generally sterile environment, or compartment, 72 indicated by a broken line in the figure. Where the generally sterile environment 72 is provided, generally sterile air is upwardly directed by lifting the container 62 with the container lifter 66 into the cleaning box 14". The upwardly directed sterile air is then conducted through a vent pipe into a product tank in accordance with the principles illustrated in FIG. 1. Further, all elements connected to, disposed within, and extending below the cleaning box 14" are within the generally sterile environment 72 during production, except for those elements that can be positioned outside of the generally sterile environment 72 without affecting the hygiene of the generally sterile environment 72, such as, for example, the removable cover 68.

Elements other than those illustrated in FIG. 3 that may be disposed within the generally sterile environment 72 include the second end 22 of the filling tube 16, the air collection mechanism 14, and the second end 29 of the vent pipe 28, all of which are shown in FIG. 1.

Figure 4:
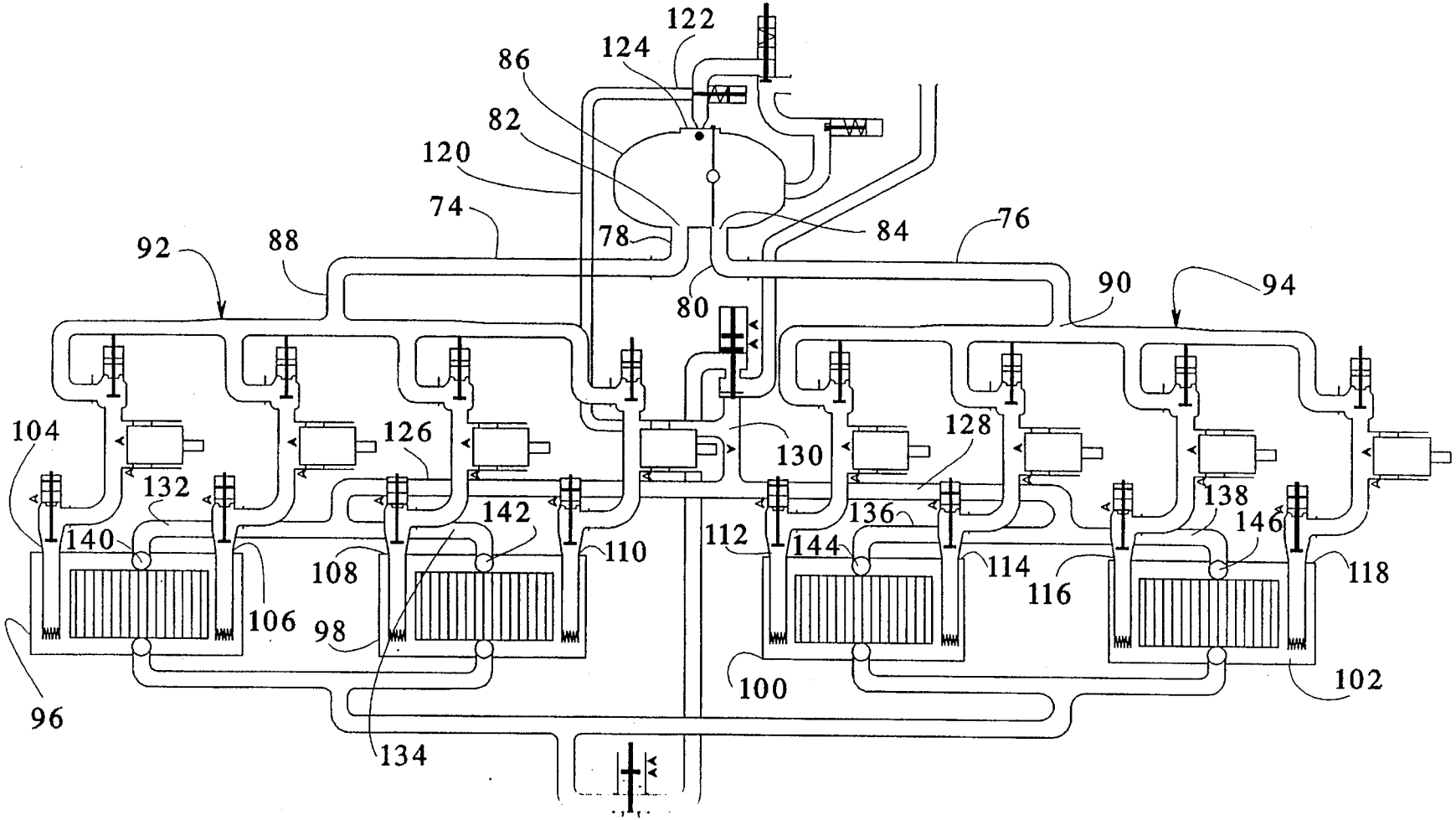
FIG. 4 is a schematic diagram of a further embodiment of a tank venting apparatus.

In one type of venting apparatus illustrated in FIG. 4, multiple filling tubes 74, 76 are connected at first ends 78, 80 to first and second filling tube openings 82, 84, respectively, in a product tank 86. Each of the filling tubes 74, 76 can be divided at second ends 88, 90 into filling tube branches 92, 94 above cleaning boxes 96–102. Each of the filling tube branches 92, 94 is in fluid communication with second ends 88, 90 of filling tubes 74, 76, respectively. First and second filling tube branch openings 104–118 are formed in each of the cleaning boxes 96–102.

A vent pipe 120 is connected at a first end 122 to a vent opening 124 in the product tank 86. The vent pipe 120 is divided into first and second vent pipes 126, 128, at a second end 130 of the vent pipe 120 above cleaning boxes 96–102. The first and second vent pipes 126, 128 are further divided into vent pipe branches 132, 134 and 136, 138, respectively. Vent pipe branches 132–138 are connected to vent pipe branch openings 140–146, respectively.

Figure 5:
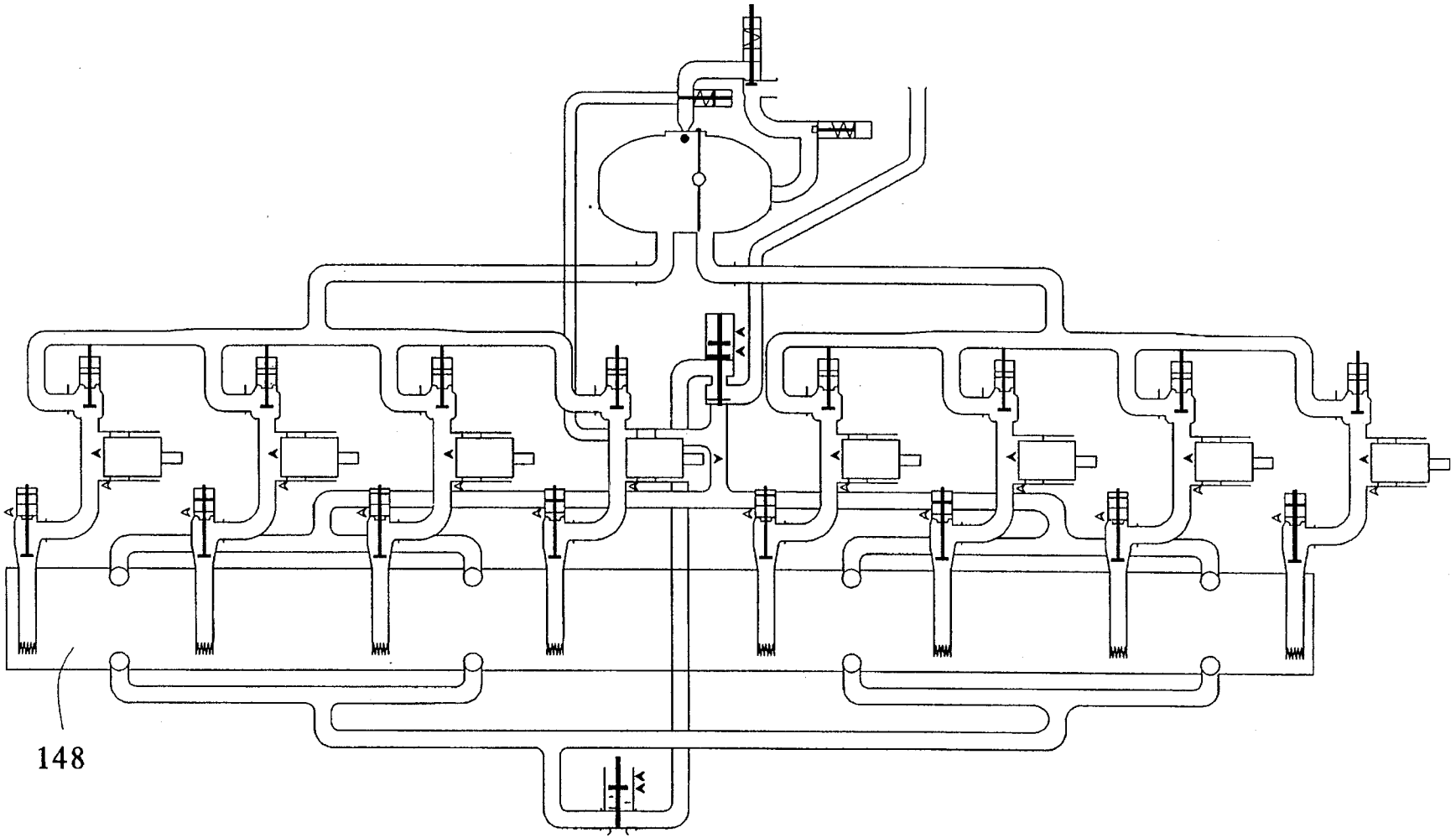
FIG. 5 is a schematic diagram of a still further embodiment of a tank venting apparatus.

In place of the cleaning boxes 96–102, a single cleaning box 148, adapted to receive multiple filling tube branches and multiple vent pipe branches, can be provided as shown in FIG. 5. Thus, the number of cleaning boxes, vent pipe branches and filling tube branches can be varied in accordance with the principles discussed herein.

In a method of venting a fluid dispensing apparatus, a container is moved into a fill position in a first step. The container is adapted to receive fluid dispensed from a product tank. Air, displaced by moving the container into the fill position, is then directed into the product tank through a vent pipe connected to the product tank in a second step. A further step may include dispensing cleaning fluid through both the product tank and the vent pipe simultaneously.

Although the present invention has been described with reference to specific embodiments, those of skill in the an will recognize that changes may be made thereto without departing from the scope and spirit of the invention as set forth in the appended claims.

We claim as our invention:

1. A packaging machine comprising:

a product tank adapted to receive and dispense a fluid material, the product tank having a vent opening in fluid communication with head space in the product tank, the pressure of the head space being about atmospheric pressure;

a clean cover;

a filling tube extending from and in fluid communication with the product tank at a first end, the filling tube having a second end having a nozzle for dispensing the fluid material flowing from the product tank through the filling tube during production;

a cleaning box surrounding the second end of the filling tube, the cleaning box having an opening adapted to receive the second end of the filling tube, a carton opening adapted to alternately receive the clean cover and at least one carton, and a vent opening;

a vent pipe connecting the vent opening of the cleaning box to the vent opening of the product tank;

a carton lifter for lifting the at least one carton into the cleaning box to a position proximate the second end of the filling tube for filling with the fluid material, air displaced by lifting the at least one carton into the cleaning box being directed through the vent pipe and into the product tank to reduce any underpressure in the head space of the product tank to thereby maintain the pressure of the head space at about atmospheric pressure and facilitate rapid filling of the cartons with the fluid material from the fill tank.

2. A packaging machine according to claim 1 and further comprising a housing disposed about the cleaning box and carton lifter wherein the housing forms a closed, generally sterile environment and wherein the vent pipe is a conduit for directing sterile air from the air collection mechanism to the product tank.

3. A packaging machine according to claim 1 wherein placement of the clean cover over the carton opening seals the cleaning box to facilitate a flow of a cleaning fluid about the second end of the filling tube .and through the vent tube to clean the filling tube, the vent opening of the cleaning box, and the vent opening of the product tank when the packaging machine undergoes a cleaning cycle.

* * * * *